United States Patent [19]

Struck et al.

[11] 4,391,682

[45] Jul. 5, 1983

[54] METHOD FOR ELECTROLYTIC PRODUCTION OF HYDROGEN

[75] Inventors: Bernd D. Struck, Langerwehe; Robert Junginger, Böblingen; Dagmar Boltersdorf, Düren, all of Fed. Rep. of Germany

[73] Assignee: Kernforschungsanlage Jülich GmbH, Fed. Rep. of Germany

[21] Appl. No.: 228,796

[22] Filed: Jan. 26, 1981

[30] Foreign Application Priority Data

Feb. 11, 1980 [DE] Fed. Rep. of Germany ..... 3005032

[51] Int. Cl.[3] ..... C25B 1/02; C25B 1/22

[52] U.S. Cl. ..... 204/104; 204/129

[58] Field of Search ..... 204/104, 129

[56] References Cited

U.S. PATENT DOCUMENTS 704,831 7/1902 Jacobs ..... 204/104

4,059,496 11/1977 Schulten ..... 204/104

4,191,619 3/1980 Struck ..... 204/129

4,330,378 5/1982 Boltersdorf ..... 204/104

*Primary Examiner*—T. M. Tufariello

*Attorney, Agent, or Firm*—Frishauf, Holtz, Goodman & Woodward

[57] ABSTRACT

A reduction of the voltage across the electrolysis cell in which hydrogen is produced in the sulfuric acid hybrid closed cycle process by use of an electrolysis cell having an intermediate chamber between the anode and cathode chamber through which a separate electrolyte is caused to flow, is obtainable under operation with the electrolytes in both the cathode and the anode chambers having a concentration of sulfuric acid by weight of about 50% or more. It is found that the undesired formation of hydrogen sulfide and of sulfur remains at a tolerable small level if the catholyte is continuously renewed. A low specific resistance cation membrane is preferably used between the cathode and intermediate chambers, as well as between the anode and intermediate chambers.

5 Claims, 1 Drawing Figure

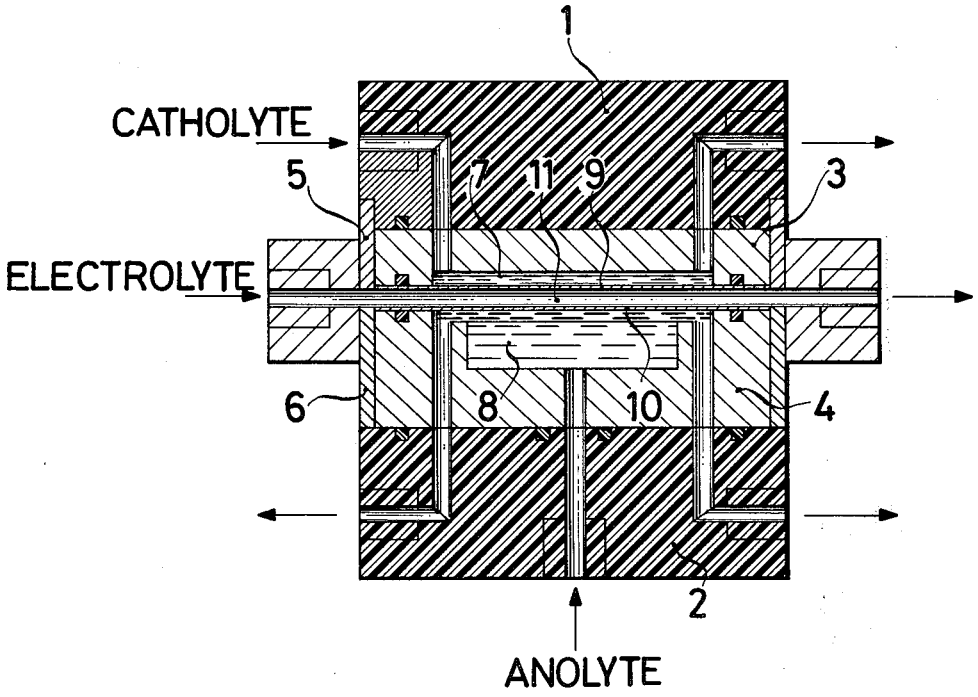
1
CATHOLYTE
5
7
11
9
3
ELECTROLYTE
6
8
10
4
2
ANOLYTE

METHOD FOR ELECTROLYTIC PRODUCTION OF HYDROGEN

The present invention concerns a process for electrolytic production of hydrogen of the kind in which hydrogen is separated at the cathode and sulfurous acid is oxidized to sulfuric acid at the anode, while the anode chamber is separated from the cathode chamber by an intermediate chamber. A separation electrolyte flows through the intermediate chamber, so that the three chambers are provided with separate electrolyte flows. The intermediate chamber is separated from the cathode chamber by a cationic exchange membrane, while between the intermediate chamber and the anode chamber there is provided either a cationic exchange membrane or a diaphragm.

The electrolytic production of hydrogen plays a significant role in the sulfuric acid hybrid closed-cycle process. In this process, the hydrogen is obtained cathodically by electrolysis of an aqueous sulfuric acid medium, while sulfurous acid is anodically oxidized to sulfuric acid which thereafter is decomposed at high temperature with regeneration of $SO_2$ and production of $O_2$. The decomposition reaction requires practically water-free sulfuric acid, for which reason the sulfuric acid concentration in the electrolytes, and particularly in the anolytes, should be as high as possible, in order to keep as small as possible the energy required to concentrate the anolyte sulfuric acid. Limits, however, exist on the choice of particularly high sulfuric acid concentrations in electrolytes since in the concentration ranges here coming into consideration, the electrical conductivity and the electrochemical kinetics become less favorable with increasing sulfuric acid concentrations. At the present time, sulfuric acid concentrations of about 50% by weight in the anode chamber are regarded as optimal.

An important problem of the above-outlined electrolysis process arises because care must be taken by provision of as high a conductivity as possible for all components in order that the electrolysis voltage may be as low as possible, while on the other hand $SO_2$ must be prevented from proceeding from the anode chamber over to the cathode and there being reduced to sulfur or to $H_2S$, which would lead to a rapid poisoning of the active cathode layer.

In order to prevent such poisoning, there has been developed by the assignee of the present application a process (described in U.S. Ser. No. 945,693, filed Sept. 25, 1978) in which process the anode chamber is separated from the cathode chamber by an intermediate chamber through which a sufficient electrolyte flow is provided for a continuous carrying away of the sulfur dioxide that crosses over into the intermediate chamber from the anode chamber. As the separating walls between the electrode chambers and the intermediate chamber, cationic exchange membranes or diaphragms are selected. In the case diaphragms are used, a certain overpressure in the intermediate chamber with respect to the anode chamber produces an electrolyte transport through the separating diaphragm from the intermediate chamber into the anode space that opposes the possible $SO_2$ migration just mentioned.

In practice, it has now been found that the optimizing of such electrolyses runs into difficulties because the internal resistance of the three-chamber electrolysis cells is relatively high, especially when cation exchange membranes are used as separators and the sulfuric acid content is over 30%, whereas porous diaphragms provide no satisfactory separation of the various electrolytes of the anode, cathode and intermediate chambers.

The heretofore utilized cation exchange membranes of the type available under the trademark Nafion® have surface resistivities depending very strongly upon the sulfuric acid concentration which are high for high sulfuric acid concentrations. For this reason, the use of cation exchange membranes on the anode side of the intermediate chamber did not come into consideration, since sulfuric acid concentrations lying below 50% by weight were considered of no interest in the frame of the overall process. For the cathode side, on the other hand, cation exchange membranes seemed acceptable as separators since the sulfuric acid concentration of the catholyte is not subject to the requirement of particularly high values relating to the decomposition reaction and can be set somewhere between 0 and 20% by weight. Accordingly, sulfuric acid concentrations in the region of 30% by weight seemed appropriate for the intermediate chamber.

Thus, although cation exchange membranes in themselves might be desirable as separators for the above-outlined three-chamber process, since in that way the best possible separation of the various electrolytes of the cell can be obtained, there remained substantial reservations regarding the provision of cation exchange membranes on the anode side of the intermediate chamber, since such membranes were chosen for operation on the cathode side with relatively low sulfuric concentration, particularly between 0 and 10% by weight, which are the best suited for the use of a cation exchange membrane and, besides, appeared to be the best for avoidance of disturbing by-products on the cathode side.

The above-outlined problems were substantially reduced in magnitude by an improved process developed by the assignee of the present application, which is described in copending U.S. patent application Ser. No. 208,933, filed Nov. 21, 1980, which made clear that contrary to the theretofore conventional practice, a cation exchange membrane on the anode side of the intermediate chamber of particular specifications is satisfactory, can be installed throughout in the cell, and leads to favorable results. According to the above-mentioned process, there is provided for separating the intermediate chamber from the anode chamber a cation exchange membrane of a specific resistance in 55% (by weight) sulfuric acid at 80° C. which is less than 30 ohm-centimeters. On the cathode side in that case, there is preferably used as the separator a cation exchange membrane of the previously used kind and a sulfuric acid concentration of the catholyte of less than about 20% by weight and especially of between 0 and 10% by weight, while the sulfuric acid concentration of the anolyte should lie between 40 and 60% by weight. The cell voltages thereby obtained are still relatively high.

THE INVENTION

It is an object of this invention to reduce the cell voltage still more so far as possible.

It has been found that as the result of the differing sulfuric acid concentrations in the anode and cathode chambers respectively, a notable influence on the cell voltage is exerted such that overall a lower voltage results if in the cathode chamber also a relatively high sulfuric acid concentration is chosen and at the same time, accordingly, a cation exchanger membrane of low surface resistivity is used at high sulfuric acid concentrations.

The process of the invention for electrolytic production of hydrogen according to the invention is hence characterized in that in the anode chamber, as well as in the cathode chamber, a sulfuric acid concentration of at least 40% and preferably at least 50% by weight is provided and as a separating membrane on the cathode side, a cation exchange membrane having a specific resistance in 55% (by weight) sulfuric acid at 80° C., which is less than about 30 ohm-centimeters.

In this manner, a lowering of the cell voltage by about 10 to 20% can be obtained. The formation of disturbing by-products, S and $H_2S$, to be feared from reduction of sulfuric acid at increased sulfuric acid concentrations in the cathode chamber remains within tolerable limits, particularly if a continuous exchange (renewal) of catholyte is provided. For this purpose, the cathode in particular should be constituted as a flow-through electrode.

The sulfuric acid concentration in the catholyte and in the anolyte can be chosen according to the desired manner of operation of the cell from among values around 50% by weight, taking account of the fact that with increasing concentration of the catholyte and increasing temperature the formation of interfering by-products is of greater consequence. Thus, in the cathodic separation of hydrogen in 75% (by weight) sulfuric acid at 80° C., noticeable quantities of hydrogen sulfide are formed and at 130° C., sulfur appears as a by-product. At present, therefore, concentrations between 50 and 60% by weight at an operating temperature in the region from 80° to 90° C. are regarded as particularly favorable. The electrolysis can basically be carried out at all temperatures above 0° C. at which the aqueous system remains reasonably manageable. At lower temperatures, however, the reduction of the conductivity of the relatively concentrated sulfuric acid is a hindrance.

The intermediate or separating electrolyte can—unlike the anolyte and the catholyte—have a lower sulfuric acid concentration and about 30% by weight sulfuric acid is preferred because at this concentration there lies a conductivity maximum. In such a case there exists, further, the possibility of the penetration of water out of the intermediate chamber into the adjoining chambers by osmosis. If the water transport by osmosis is to be avoided, the sulfuric acid concentration of the intermediate or separating electrolyte must be of the same magnitude as that in the anode and cathode chambers. That means that preferably the sulfuric acid concentration in all three chambers should be chosen at about 45 to 55% by weight.

The particular kind of embodiment of an electrolysis cell involved in the above-mentioned process is already described in the aforesaid copending U.S. patent application of the same assignee, Ser. No. 208,933, filed Nov. 21, 1980, the disclosure of which is therefore in full incorporated by reference here.

THE DRAWING

The advantage of the mode of operation according to the present invention can thus be shown with reference to an illustrative example described below with reference to the annexed drawing, the single FIGURE of which is a schematic cross-section of a cylindrical three-chamber electrolysis cell.

This cell, constituted essentially in axial symmetry, is held together by external plastic discs 1 and 2 (made, for example, of polyvinylidene fluoride), to which the graphite casing halves 3 and 4 are immediately adjacent. Two copper rings 5 and 6 reinforce the graphite and, at the same time, provide electric current connections. The casing halves 3 and 4, respectively provided with the copper rings 5 and 6, are electrically separated from each other by the intermediate chamber of synthetic plastic material. The cathode 7 and the anode 8 are constituted as flow-through electrodes and lie against the separators 9 and 10 which are constituted of cation exchange membranes and form the boundaries of the intermediate chamber 11. The supply of electrolyte flows is indicated by arrows on the drawing.

EXAMPLE

With a three-chamber cell of the above-described kind, electrolyses were carried out in each case at constant current densities under the following conditions:

| | |
|---|---|
| Anode: | Graphite felt, Sigri GFA 10 |
| Cathode: | Graphite felt with a platinized (5 mg/cm$^2$) side, which is in contact with the membrane |
| Separators: | Neosepta C66-5T® |
| Temperature: | 88° C. |
| Pressure: | 1 bar |
| Anode chamber: | 50 wt. % $H_2SO_4$ + 0.15 wt. % HI + $SO_2$ (at saturation concentration for 1 bar) |
| Intermediate chamber: | 30 wt. % $H_2SO_4$ |
| Cathode chamber: | $H_2SO_4$, of which the concentration was varied between 1 and 50% by weight |

As explained in the above-mentioned copending application Ser. No. 208,933, the separator material identified in the above example is a material obtained by polymerization of styrol with divinylbenzol in the presence of polyvinyl chloride and the introduction of $SO_3H$ groups.

The results obtained in this series of experiments are collected in the following table. It shows clearly that the electrical energy used for the electrolytic production of hydrogen can be substantially lowered merely by raising of the electrolyte concentration in the cathode chamber.

TABLE

Cell Voltage as Function of Electrolyte Conc. and Current Density

| Electrolyte Concentration (wt. % $H_2SO_4$) | | | Cell Voltage (mV) at Various Current Densities | | | | | |
|---|---|---|---|---|---|---|---|---|
| In the Cathode Chamber | In the Intermediate Chamber | In the Anode Chamber | 50 mA/cm$^2$ | 100 mA/cm$^2$ | 200 mA/cm$^2$ | 300 mA/cm$^2$ | 400 mA/cm$^2$ | 500 mA/cm$^2$ |
| 1 | 30 | 50 | | 610 | | | | |
| 10 | 30 | 50 | 480 | 585 | 765 | | | |
| 30 | 30 | 50 | 455 | 555 | 720 | 880 | 1030 | 1200 |

TABLE-continued

| Cell Voltage as Function of Electrolyte Conc. and Current Density | | | | | | | | |
|---|---|---|---|---|---|---|---|---|
| Electrolyte Concentration (wt. % $H_2SO_4$) | | | Cell Voltage (mV) at Various Current Densities | | | | | |
| In the Cathode Chamber | In the Intermediate Chamber | In the Anode Chamber | 50 mA/cm$^2$ | 100 mA/cm$^2$ | 200 mA/cm$^2$ | 300 mA/cm$^2$ | 400 mA/cm$^2$ | 500 mA/cm$^2$ |
| 50 | 30 | 50 | 420 | 495 | 625 | 745 | 860 | 990 |

We claim:

1. A process for electrolytic production of hydrogen in which hydrogen is cathodically evolved and sulfurous acid is anodically oxidized to sulfuric acid, utilizing an electrolyzer in which the anode chamber is separated from the cathode chamber by an intermediate chamber which is separated from the cathode chamber by a cation exchange membrane and from the anode chamber by a porous diaphragm, in which method a separating electrolyte is caused to flow through said intermediate chamber, and separate anodic and cathodic electrolytes are caused to flow respectively through the anode and cathode chambers, said method incorporating the improvement which consists in that:

in the electrolyte flowing in the anode chamber as well as in the electrolyte flowing in the cathode chamber, the concentration of sulfuric acid of at least 45% is provided, and the membrane separating the intermediate chamber from the cathode chamber is constituted of a material obtained by polymerization of styrol and divinylbenzol in the presence of polyvinyl chloride and the introduction of $SO_3H$ groups, and has a specific resistance in 55 wt.% sulfuric acid at 80° C., which is less than 30 ohm/cm.

2. A process for electrolytic production of hydrogen in which hydrogen is cathodically evolved and sulfurous acid is anodically oxidized to sulfuric acid, utilizing an electrolyzer in which the anode chamber is separated from the cathode chamber by an intermediate chamber which is separated by cation exchange membranes respectively from the cathode chamber and from the anode chamber, in which method a separating electrolyte is caused to flow through said intermediate chamber, and separate anodic and cathodic electrolytes are caused to flow respectively through the anode and cathode chamber, said method incorporating the improvement which consists in that:

in the electrolyte flowing in the anode chamber as well as in the electrolyte flowing in the cathode chamber, the concentration of sulfuric acid of at least 45% is provided, and the membrane separating the intermediate chamber from the cathode chamber is constituted of a material obtained by polymerization of styrol and divinylbenzol in the presence of polyvinyl chloride and the introduction of $SO_3H$ groups, and has a specific resistance in 55 wt.% sulfuric acid at 80° C., which is less then 30 ohm/cm.

3. A process as defined in claim 1 or claim 2, in which the sulfuric acid concentration provided both in the electrolyte of the anode chamber and in the electrolyte of the cathode chamber is at least 50 wt.%.

4. A process as defined in claim 1 or claim 2, in which also the separator between the anode chamber and the intermediate chamber is a cation exchange membrane constituted of a material obtained by the polymerication of styrol with divinylbenzol in the presence of polyvinyl chloride and the introduction of $SO_3H$ groups, and having a specific resistance in 55 wt.% sulfuric acid at 80° C., which is less than 30 ohm/cm.

5. A process as defined in claim 1 or claim 2, in which the sulfuric acid concentration provided both in the electrolyte of the anode chamber and in the electrolyte of the cathode chamber is at least 50 wt.%, in which the sulfuric acid concentration in the intermediate chamber is approximately 30 wt.%, and in which also the separator between the anode chamber and the intermediate chamber is a cation exchange membrane constituted of a material obtained by polymerization of styrol with divinylbenzol in the presence of polyvinyl chloride and the introduction of $SO_3H$ groups, and having a specific resistance in 55 wt.% sulfuric acid at 80° C. which is less than 30 ohm/cm.

* * * * *